US006383026B1

(12) United States Patent
Chen

(10) Patent No.: US 6,383,026 B1
(45) Date of Patent: May 7, 2002

(54) COMBINATION PLUG

(76) Inventor: Ching-Hsiung Chen, No. 77, Chuan-Fu Rd., Cheng-Kung Village, Jen-Te Hsiang, Tainan Hsien (TW)

( * ) Notice: Subject to any disclaimer, the term of this patent is extended or adjusted under 35 U.S.C. 154(b) by 0 days.

(21) Appl. No.: 09/760,290

(22) Filed: Jan. 16, 2001

(51) Int. Cl.[7] ..... H01R 13/68
(52) U.S. Cl. ..... 439/622
(58) Field of Search ..... 439/621, 622; 337/255, 198, 197

(56) References Cited

U.S. PATENT DOCUMENTS 5,791,941 A * 8/1998 Wang ..... 439/622
5,851,127 A * 12/1998 Huang ..... 439/622
5,876,250 A * 3/1999 Deng ..... 439/622
5,906,515 A * 5/1999 Lin ..... 439/622
6,039,607 A * 3/2000 Chueng ..... 439/622

* cited by examiner

*Primary Examiner*—Gary Paumen
(74) *Attorney, Agent, or Firm*—Fei-Fei Chao; Venable, Baetjer, Howard & Civiletti, LLP

(57) ABSTRACT

A combination plug has an outer housing, a plug base inserting into the outer housing, and a conductor body retaining in the plug base. A fuse guard pivots in a front portion of the outer housing to enable easy access to the fuse. The conductor body defines two pairs of holes matching different specific power wires. The conductor body is inserted in the plug base for assembling power wire conveniently and safely.

13 Claims, 3 Drawing Sheets

COMBINATION PLUG

BACKGROUND OF THE INVENTION

1. Field of the Invention

The present invention relates to a combination plug, and more particularly, to a combination plug having a fuse cover for easy access to a fuse therein, and a conductor body for connection of an electrical cord therein conveniently and safely.

2. Description of Related Art

With reference to FIG. 5, a conventional combination plug has an outer housing (70), an inner housing (80) slidably inserting into the outer housing (70), a fuse assembly (81) retained within the inner housing (80), and a snap-fitted conductor body (90) fitted within the outer housing (70).

The outer housing (70) has a separable door (72), and an upper opening (73) defined in an upper face of the outer housing (70) and matching the separable door (72). The inner housing (80) includes a pair of prongs (82) which are passable through respective slots (71) of the outer housing (70) and a pair of openings (83) for receiving the prongs (82) of another plug to enable two cables to receive electricity. The fuse assembly (81) includes an H-shaped plastic fuse holder (810), a pair of fuses (811) held in respective grooves of the plastic fuse holder (810), and four copper covers (812). Each cover (812) encloses a respective terminal of the H-shaped fuse holder (810). The snap-fitted conductor body (90) includes a conductor tap casing (91), two conduction wires (92), and two conductor taps (93). The provision of the copper covers (812) is to provide a larger contact surface between the fuse (811) and the conductor taps (93) of the conductor body (90) and the prongs (82).

In assembly, the inner housing (80) retaining the fuse assembly (81) is inserted in the outer housing (70), and the fuse assembly (81) is securely retained in the inner housing (80) by a door (72). The conductor body (90) retaining the power wire (92) snaps into the inner and outer housings (80)(70).

The above-mentioned combination plug is easily assembled, however it has the shortcoming that the conductor body does not provide a sufficiently secure engagement with the outer and inner housings, and the fuse is hard to repair from the inner housing.

To overcome the shortcomings, the present invention tends to provide an improved plug for a combination plug to mitigate and obviate the aforementioned problems.

SUMMARY OF THE INVENTION

The objective of the present invention is to provide a combination plug having an outer housing forming a fuse chamber therein, a plug base inserted in the outer housing, and a conductor body securely retained in the plug base.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
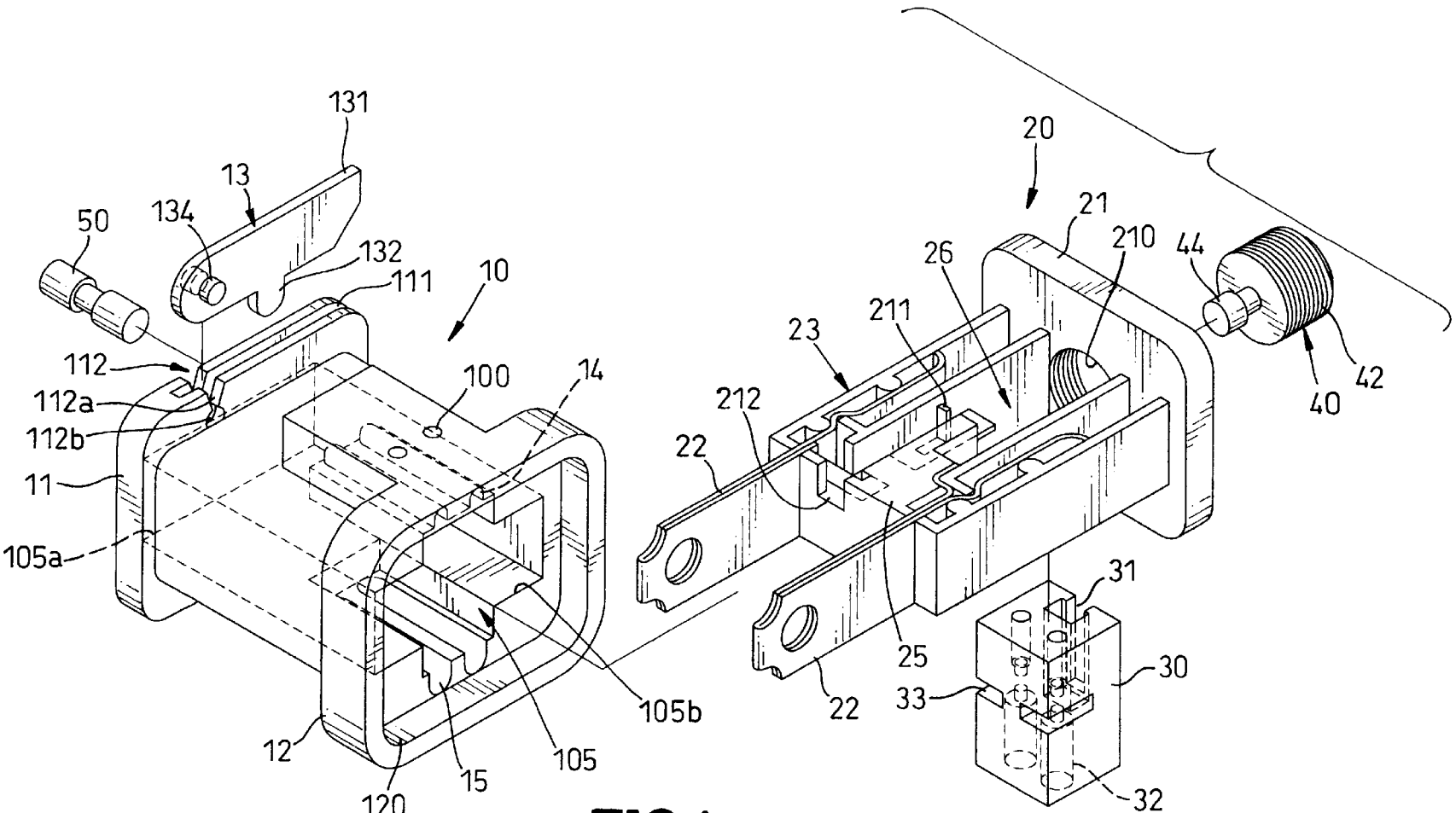
FIG. 1 is an exploded perspective view of a combination plug in accordance with the present invention.

With reference to FIG. 1, a combination plug includes an outer housing (10), a plug base (20) insertable in the outer housing (10), a conductor body (30) retainable in the plug base (20) and in the outer housing (10).

Figure 4:
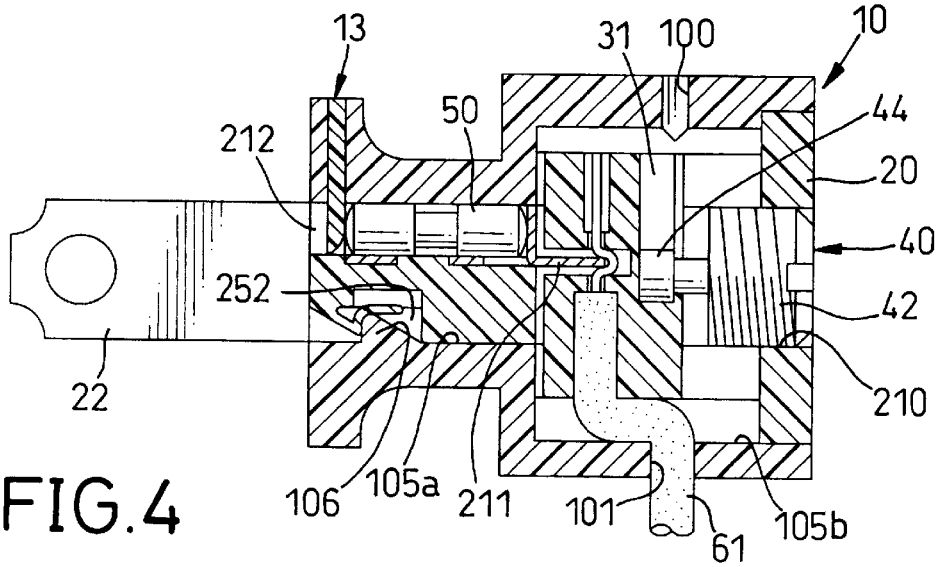
FIG. 4 is a cross side section view of the assembled combination plug in accordance with the present invention and in a second mode.
Figure 3:
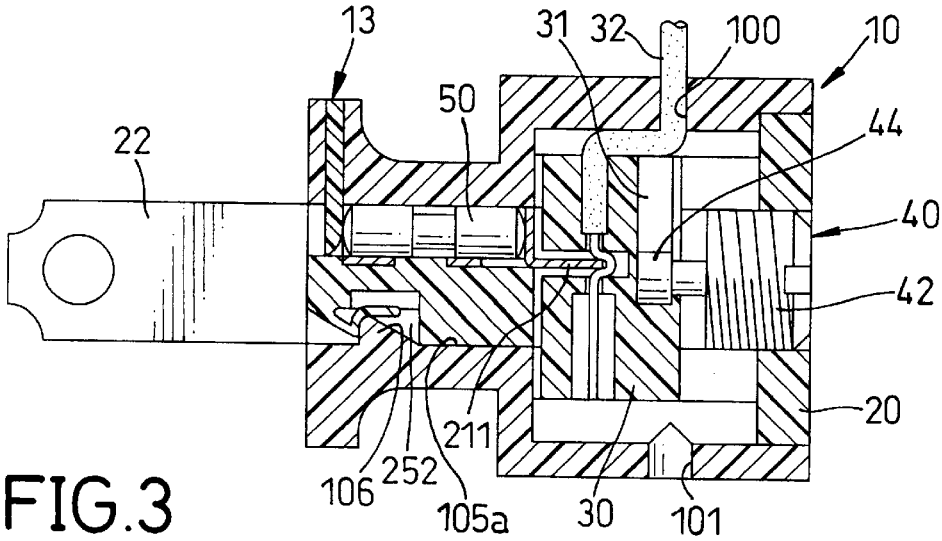
FIG. 3 is a cross side section view of the assembled combination plug in accordance with the present invention and in a first mode.
Figure 5:
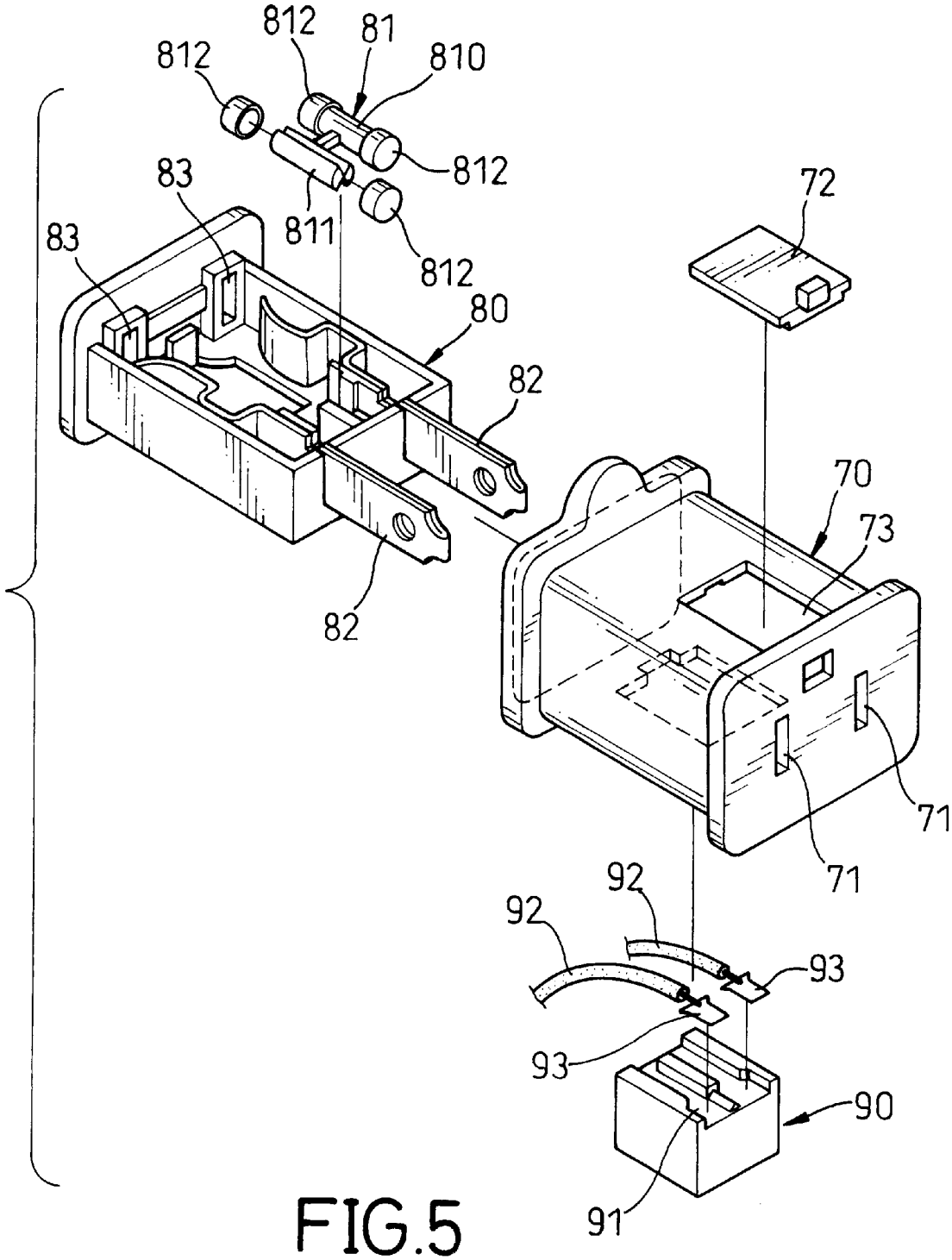
FIG.5 PRIOR ART
FIG. 5 is an exploded perspective view of a conventional combination plug.

Referring to FIGS. 1, 3, and 4, the outer housing (10) is a hollow body with a first end plate (11), a second end plate (12), and a tunnel (105) extending between the first and second end plates (11,12). The first end plate (11) has a periphery, and a slot (111) defined in a top and side of the periphery. The slot (111) communicates with the tunnel (105). A notch (112) is defined in the slot (111) of the top of the periphery, and comprises an upper portion (112*a*) formed as an inverted V, and a lower portion (112*b*) formed as a circle and in communication with the upper portion (112*a*). The tunnel (105) is in communication with a recess (120) defined in the second end plate (12). The tunnel (105) has a rear portion (105*a*) and a front portion (105*b*). The rear portion (105*b*) is substantially cross-shaped when viewed from an end and includes an upper trench and a lower trench. The front portion of the tunnel (105) has a resilient barb (106) formed on a bottom face thereof. A top face of the upper trench has two spaced-apart first grooves (14) extending longitudinally between the first and second end plates (11,12). A bottom face of the lower trench has two spaced-apart second grooves (15) extending longitudinally between the first and second end plates (11, 12). Two first holes (100) are defined in a top wall of the hollow body (10) and respectively communicate with the first grooves (14). Two second holes (101) are defined in a bottom wall of the hollow body (10) and respectively communicate with the second grooves (15).

A fuse cover (13) substantially comprises a plate with a tongue (132) extending downward from a bottom edge thereof, and a knob (134) extending from a back face and a front face thereof. The fuse cover (13) is sized to be slidingly receivable in the slot (111) of the first end plate (11). The knob (134) is sized to be snappingly receivable in the circle (112*b*) of the notch (112) of the first end plate (11).

The plug base (20) comprises a rear plate (21) with two resilient tongs (23) extending from a back face thereof, and a threaded hole (210) defined between the two tongs (23). Each tong (23) securely and respectively receives one of two blades (22) therein, and each blade (22) protrudes from a distal tip of the respective tong (23). A bridge (25) extends between the blades (22) and from the distal tip to the longitudinal center of the blades (22). A cavity (26) is defined among the back face of the rear plate (21), the bridge (25) and the tongs (23). An L-shaped tooth (211) extends outwardly and upwardly from one of the blades (22) and extends rearward to the rear plate (21) such that it protrudes from the bridge (25). A fuse chamber (212) is defined between the tongs (23) and at a top portion of the bridge (25). The fuse chamber (212) has an open front end at the front of the bridge (25), and a closed rear end formed by the L-shaped tooth (211). A catch hollow (252) is defined in an under face of the bridge (25).

The conductor body (30) is substantially brick-shaped and has an upright T-shaped mortise (31) in a first side face and two spaced-apart cutouts (33) centrally extending respectively into a second and a fourth face side face, and a third and the fourth side face. Two upright bores (32) extend between a top face and a bottom face of the conductor body (30) and respectively communicate with the cutouts (33), whereby the bores (32) are separated into narrow upper and wide lower portions. The conductor body (30) is configured to be slidingly receivable in the cavity (26) of the plug base (20) such that it can slide between and abut respectively the back face of the rear plate (21) and the bridge (25).

A piston (40) comprises a drum (42) with a threaded periphery configured to engage with the threaded hole (210) of the plug base (20), and a T-shaped cylindrical tenon (44) extending from a rear face thereof. The tenon (44) is sized to slidingly engage with the mortise (31) of the conductor body (30).

A fuse (50) is sized to be receivable in the fuse chamber (212) of the plug base (20), such that a first end of the fuse (50) abuts the upright portion of the tooth (211) and a second end of the fuse (50) is received in the open front end of the bridge (25).

Figure 2:
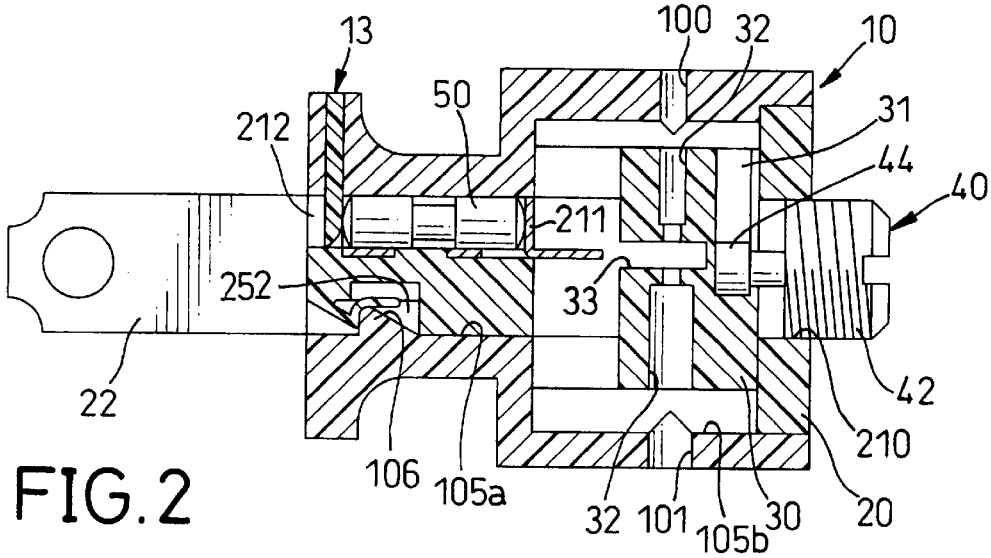
FIG. 2 is a cross side section view of the assembled combination plug in accordance with the present invention.

In assembly, referring to FIG. 2, the piston (40) is screwed into the threaded hole (210) of the plug base (20) such that the tenon (44) protrudes into the cavity (26). Then, the conductor body (30) is fed into the cavity (26) of the plug base (20) whereby the tenon (44) is securely received in he mortise (31). The fuse (50) is then fitted in the fuse chamber (212) of the plug base (20). Next, the combined plug base (20), fuse (50), piston (40) and conductor body (20) are fitted in the outer housing (10) by extending the blades (22) into the tunnel (105) via the second end plate (12), until the blades (22) protrude from the first end plate (11) and the barb (16) is snappingly received in the catch hollow (252) of the plug base (20). When the conductor body (30) abuts the back face of the rear plate (21), the upright bores (32) align respectively with the first and second holes (100,101) of the outer housing (10) such that two first electrical wires (32) can be fed through the first holes (100) and into the narrow upper portion of each of the bores (32), with a bare tip of each first electrical wire (32) extending into the respective cutout (33) and wide lower portion of the bores (32). Then the piston (40) is screwed towards the bridge (25), as shown in FIG. 3 and the L-shaped tooth (211) enters the respective cutout (33) such that the bare tip of one of the first electrical wires (32) is deformed and thus secured in the conductive body (30). Alternatively, two second electrical wires (61) can be fed through the second holes ( 101) and into the wide lower portion of each of the bores (32), with a bare tip of each second electrical wire (61) extending through the respective cutout (33) and narrow upper portion of the bores (32). Then the piston (40) is screwed towards the bridge (25), as shown in FIG. 4 and the L-shaped tooth (211) enters the respective cutout (33) to secure the second electrical wires (61) in the conductive body (30). It can be seen in both FIG. 3 and FIG. 4, that sheathing of the first and second electrical wires (32) and (61) respectively extends along the upper and lower trenches as the conductor body (30) progresses from the rear plate to the bridge (25), thereby providing a secure pull-resistant engagement for the wires (32, 61). The knob (134) of the fuse cover (13) is snappingly received in the circle (112*b*) of the notch (112). The fuse (50) is fed into the fuse chamber (212) via the opening of the bridge (25).The fuse cover (13) is pivoted down into the slot (111) of the first end plate (11) such that the tongue (132) abuts a front face of the barb (16), whereby the fuse (50) is prevented from escaping the fuse chamber (212) by the fuse cover (13). To remove the fuse (50) from the combination plug, a user only has to pivot upward the fuse cover (13) by means of pushing a distal edge of the fuse cover (13) which protrudes from the side slot (111) in the first end plate (11).

The combination plug of the present invention has the following advantages:

(i) ease of use. The use of the piston to clamp wires in the plug eliminates the need for special tools which may not be easy to find or use.

(ii) versatility. Two ranges of wire sizes can be securely accepted due to the narrow and wide portions of the bores.

(iii) simplicity. A user only has to align wire tips with the first or second holes of the housing and further alignment with the bores is automatic when the conductor body is fully drawn back to the rear plate.

(iv) safety. The teeth provide a sure grip on the bare tips of the electrical wires. The zigzag courses of the wires' sheathing in the trenches provides an excellent secondary grip.

(v) security. The engagement between the resilient barb of the housing and the catch of the plug base provides further security.

(vi) ease of fuse replacement. The simple pivot of the fuse cover to access the fuse means that no tools are required to replace or check the fuse.

Although the present invention has been explained in relation to its preferred embodiment, it is to be understood that many other possible modifications and variations can be made without departing from the spirit and scope of the invention as hereinafter claimed.

What is claimed is:

1. A combination plug comprising:

an outer housing defining a first end with a pivot device, a second end, a tunnel extending between the first and second ends, at least two first holes communicating the tunnel with a top exterior of the housing, at least two second holes communicating the tunnel with a bottom exterior of the housing, and a locking device formed in the tunnel;

a plug base with a rear plate, two tongs each with a first distal end and a second end joined with the rear plate, a threaded hole defined through the rear plate and between the second ends of the tongs, a bridge extending between the tongs from the first distal thereof towards the rear plate, a locking element engageable with the locking device of the outer housing, a fuse chamber with an open first end and a second end, and a cavity surrounded by the rear plate, the tongs and the bridge;

two electrically-conductive blades respectively received in the tongs of the plug base and protruding from a front thereof, and at least one electrically-conductive blade having a tooth extending therefrom and through the bridge to close the second end of the fuse chamber;

a conductor body sized to be slidingly receivable in the cavity of the plug base, and defining two upright bores, two lateral cutouts respectively intersecting one of the upright bores, and a receiving device;

a piston with a threaded exterior engageable in the threaded hole of the plug base, and an engagement device extending from an end face thereof to rotatably engage with the receiving device of the conductor body;

a fuse receivable in the fuse chamber of the plug base; and a retaining device pivotally securable with the pivot device of the first end of the housing to close and open the first end of the fuse chamber, whereby electrical wires penetrate the outer housing via either the first holes or the second holes and enter the upright bores and cutouts of the conductor body whereafter the conductor body is received in the plug base which is in turn received in the outer housing, the fuse is secured in the fuse chamber by abutting the tooth and the retaining device, electrical wires penetrate the outer housing via either the first or second holes and enter the upright bores and cutouts of the conductor body and the conductor body is driven away from the rear plate by rotation of the piston such that the tooth of the electrically-conductive blade enters the respective cut-out to trap the respective wire and sheathing of the wires is retainedly deformed due to non-alignment of the first holes or the second holes and the upright bores.

2. The combination plug as claimed in claim 1, wherein the retaining device is a plate further sized to close the tunnel of the outer housing, and formed with at least one knob.

3. The combination plug as claimed in claim 2, wherein the retaining device is formed with two knobs on respective sides of the plate.

4. The combination plug as claimed in claim 1, wherein the locking device of the outer housing is a resilient barb and the locking element is a catch hollow defined in the bridge.

5. The combination plug as claimed in claim 1, wherein the receiving device of the conductor body is a mortise, and the engagement device of the piston is a tenon.

6. The combination plug as claimed in claim 5, wherein the mortise is T-shaped and the tenon is T-shaped.

7. The combination plug as claimed in claim 1, wherein the tunnel of the outer housing further includes an upper trench defining a pair of first grooves communicating respectively with the first holes, and a lower trench defining a pair of second grooves communicating respectively with the second holes.

8. The combination plug as claimed in claim 2, wherein the outer casing has a first end plate formed at the first end thereof and a second end plate formed at the second end thereof.

9. The combination plug as claimed in claim 8, wherein the first end plate has a slot defined in a top face and a side face, the slot being in communication with the tunnel, and a notch defined in the slot of the top face whereby the knob of the retaining device is snappingly received in the notch to allow the retaining device to pivot with respect to the outer casing.

10. The combination plug as claimed in claim 8, wherein the second end plate defines a recess in communication with the tunnel and sized to receive the rear plate of the plug base.

11. The combination plug as claimed in claim 1, wherein the upright bores of the conductive body are each separated by the respective cutout into a narrow upper portion and a wide lower portion.

12. The combination plug as claimed in claim 1, wherein each of the electrically conductive blades has one tooth.

13. A combination plug comprising:

an outer casing comprising a body with first end plate, a second end plate, a tunnel extending between the first and second end plates, the tunnel defining a central portion with an upper trench with two first longitudinal grooves, a lower trench with two second longitudinal grooves, two first holes extending between the tunnel and a top face of the body and respectively communicating with the first longitudinal grooves, two second holes extending between the tunnel and a bottom face of the body and respectively communicating with the second longitudinal grooves, a resilient barb formed in the tunnel, and a slot defined in the first end plate and communicating with the tunnel and including a notch;

a plug base sized to be receivable in the tunnel of the outer casing and including a rear plate, two tongs extending rearward from the rear plate, a threaded hole defined in the rear plate and between the two tongs, a bridge formed between the tongs and defining a fuse chamber with a front end and a rear end therein, a cavity surrounded by the rear plate, the tongs and the bridge, and a catch hollow defined in an under face of the bridge to engage with the resilient barb of the outer housing;

a piston with a threaded periphery to threadingly engage with the threaded hole of the outer casing, and a T-shaped tenon extending from a front face thereof;

a conductor body with a top and bottom face and formed with an upright mortise shaped as a T to slidingly receive the T-shaped tenon of the piston, two upright bores extending between the top face and the bottom face thereof, and two cut outs defined between the top and bottom faces a respectively communicating with upright bores;

two electrically-conductive blades respectively received in the tongs of the plug base and protruding therefrom, at least one of the electrically-conductive having an L-shaped tooth extending therefrom with an upright bar of the L-shaped tooth closing the rear end of the fuse chamber and a lateral bar of the L-shaped tooth sized to enter a respective one of the cutouts of the conductive body;

a fuse with a first end and a second end, the second end abutting the lateral bar of the tooth;

a fuse cover formed as a thin plate sized to enter the slot of the outer housing and having a double knob formed on opposite sides of the thin plate, the knobs being sized to snappingly enter the notch of the outer housing, whereby the fuse cover is pivotally mountable to the outer housing and the first end of the fuse abuts the fuse cover when the fuse cover is in a lowered position to close the tunnel of the outer housing, whereby electrical wires can penetrate the outer housing via either the top holes or the bottom holes of the outer casing, and extend into the respective upright bore and cutout of the conductor body whereafter the piston is turned to urge the conductor body away from the rear plate such that the lateral bar of the tooth penetrates the respective cutout to trap the respective electrical wire therein.

* * * * *